US010735863B2

(12) United States Patent
Sato et al.

(10) Patent No.: US 10,735,863 B2
(45) Date of Patent: Aug. 4, 2020

(54) SOUND PRODUCING DEVICE

(71) Applicant: ALPS ALPINE CO., LTD., Tokyo (JP)

(72) Inventors: Kiyoshi Sato, Niigata (JP); Akihiro Tsuchiya, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/445,742

(22) Filed: Jun. 19, 2019

(65) Prior Publication Data

US 2019/0313191 A1 Oct. 10, 2019

Related U.S. Application Data

(63) Continuation of application No. PCT/JP2017/046205, filed on Dec. 22, 2017.

(30) Foreign Application Priority Data

Jan. 13, 2017 (JP) ..... 2017-003912

(51) Int. Cl.
*H04R 7/04* (2006.01)
*H04R 7/20* (2006.01)
*H04R 11/02* (2006.01)

(52) U.S. Cl.
CPC ..... *H04R 7/04* (2013.01); *H04R 7/20* (2013.01); *H04R 11/02* (2013.01)

(58) Field of Classification Search
CPC ... H04R 7/04; H04R 7/18; H04R 7/20; H04R 11/02
See application file for complete search history.

(56) References Cited

U.S. PATENT DOCUMENTS 8,948,439 B2 2/2015 Nagumo et al.
2006/0098838 A1* 5/2006 Yoo ..... H04R 9/043 381/398

(Continued)

FOREIGN PATENT DOCUMENTS

CN 102291655 12/2011
CN 204836567 U 12/2015

(Continued)

OTHER PUBLICATIONS

Japanese Office Action for 2018-561903 dated Dec. 10, 2019.
International Search Report dated Mar. 6, 2018 in PCT/JP2017/046205 filed on Dec. 22, 2017.

*Primary Examiner* — Tuan D Nguyen
(74) *Attorney, Agent, or Firm* — IPUSA, PLLC

(57) ABSTRACT

A sound producing device includes: a frame having an opening portion; a vibration plate arranged in the opening portion; a vibration support sheet that supports the vibration plate; and a drive mechanism that drives the vibration plate, which are contained in a case. The vibration support sheet includes a vibration plate support portion that covers the opening portion and includes a peripheral fixation portion that is bent from a peripheral edge portion of the vibration plate support portion and that faces an inner end surface of the opening portion. The vibration plate is fixed to the vibration plate support portion. An adhesive layer is interposed at a portion where the peripheral fixation portion faces the inner end surface, and an adhesive pool is formed at a boundary portion between an opening edge portion of the opening portion and the vibration plate support portion.

4 Claims, 10 Drawing Sheets

(56) References Cited

U.S. PATENT DOCUMENTS

| | | | | |
|---|---|---|---|---|
| 2011/0311088 | A1 | 12/2011 | Nagumo et al. | |
| 2011/0311090 | A1* | 12/2011 | Nagumo | H04R 11/02<br>381/398 |
| 2012/0139367 | A1 | 6/2012 | Funaki et al. | |
| 2016/0165352 | A1* | 6/2016 | Zheng | H04R 9/025<br>381/412 |
| 2018/0206041 | A1* | 7/2018 | Matsuda | H04R 7/12 |

FOREIGN PATENT DOCUMENTS

| | | |
|---|---|---|
| CN | 204887427 U | 12/2015 |
| JP | 2001-245390 | 9/2001 |
| JP | 2006-033774 | 2/2006 |
| JP | 2012-004851 | 1/2012 |
| WO | 2004/030406 | 4/2004 |
| WO | 2011/016291 | 2/2011 |

* cited by examiner

SOUND PRODUCING DEVICE

CROSS-REFERENCE TO RELATED APPLICATIONS

This application is a continuation of International Application No. PCT/JP2017/046205, filed on Dec. 22, 2017 and designated the U.S., which claims priority to Japanese Patent Application 2017-003912, filed on Jan. 13, 2017. The contents of these applications are incorporated herein by reference in their entirety.

BACKGROUND OF THE INVENTION

1. Field of the Invention

The present invention relates to a sound producing device in which a vibrator composed of a vibration support sheet and a vibration plate is supported at an opening portion of a frame provided in a case and the vibration plate is vibrated by a drive mechanism.

2. Description of the Related Art

Patent Document 1 describes an invention relating to a sound producing device (an electroacoustic transducer).

In this sound producing device, a frame member is fixed within a housing, and a film and a diaphragm bonded to the film are arranged at an opening portion of the frame member. At a peripheral part of the film, a corrugation having a U-shaped pattern is formed, and a peripheral portion extending outwardly from the corrugation is bonded to an inner end surface of the opening portion of the frame member.

Inside the housing a magnetic circuit including an armature, a yoke, a magnet, and a coil is included, vibration of the armature is transmitted through a pin to a diaphragm, and sound is produced by vibration of the diaphragm.

RELATED-ART DOCUMENTS

[Patent Document 1] International Publication Pamphlet No. WO 2004/030406

In the sound producing device (electroacoustic transducer) described in Patent Document 1, as enlarged in FIG. 4 of Patent Document 1, the corrugation is formed at the periphery of the diaphragm and a peripheral portion of the film extending downwardly from the corrugation is bonded to the opening portion of the frame member. As a result, the corrugation has a shape that expands further from the opening portion of the frame member to the periphery.

In this sound producing device, the lower stiffness of the corrugation, the easier the diaphragm vibrates. In the structure of Patent Document 1, because the corrugation is formed to cover the inner end surface of the opening portion of the frame member, an adhesive that bonds the peripheral portion of the film and the inner end surface of the opening portion easily adheres to the corrugation, and the stiffness of the corrugation is easily increased by the adhesive. Therefore, it is difficult to provide a sufficient amount of adhesive between the peripheral portion of the film, extending downwardly from the corrugation, and the inner end surface of the opening portion of the frame member, and it is difficult to fix the film to the frame member with sufficient strength.

In view of the above, the present invention has an object to provide a sound producing device such that a vibration support sheet can be bonded to an opening portion of a frame with sufficient strength and vibration performance of a vibrator can be maintained at high level.

SUMMARY OF THE INVENTION

According to one aspect of the present invention, a sound producing device includes: a frame having an opening portion; a vibration plate arranged in the opening portion; a vibration support sheet that supports the vibration plate in the opening portion; and a drive mechanism that drives the vibration plate. The frame, the vibration plate, the vibration support sheet, and the drive mechanism are contained in a case. The vibration support sheet includes a vibration plate support portion that covers the opening portion and the vibration support sheet includes a peripheral fixation portion that is bent from a peripheral edge portion of the vibration plate support portion and that faces an inner end surface of the opening portion. The vibration plate is fixed to the vibration plate support portion. An adhesive layer is interposed at a portion where the peripheral fixation portion faces the inner end surface, and an adhesive pool is formed at a boundary portion between an opening edge portion of the opening portion of the frame and the vibration plate support portion.

In the sound producing device according to one aspect of the present invention, it is preferable that a raised deformation portion that surrounds an adhesion area to which the vibration plate is bonded is formed on the vibration support sheet, and the adhesive pool is provided at a position away from the raised deformation portion.

According to one aspect of the present invention, the sound producing device may be configured such that at the boundary portion with the opening edge portion of the opening portion, a peripheral recessed portion that is recessed from the vibration plate support portion toward a center in a thickness direction of the frame is formed on the vibration support sheet, and the adhesive pool is formed in the peripheral recessed portion.

Also, according to one aspect of the present invention, the sound producing device may be configured such that a frame side recessed portion that is recessed toward a center in a thickness direction of the frame is formed on the opening edge portion of the opening portion of the frame, and the adhesive pool is formed on the frame side recessed portion.

In the sound producing device according to one aspect of the present invention, the peripheral fixation portion of the vibration support sheet supporting the vibration plate is bonded to the inner end surface of the opening portion of the frame, and the adhesive pool is formed at the boundary portion between the opening edge portion of the opening portion of the frame and the vibration plate support portion. Therefore, the vibration support sheet can be fixed with a high adhesive strength in the opening portion of the frame.

Also, by providing the adhesive pool at a position outwardly away from the raised deformation portion formed on the vibration support sheet, the stiffness of the raised deformation portion is not easily affected by the adhesive, and the vibration characteristics of the vibration plate supported by the vibration support sheet are not easily affected by the adhesive.

DETAILED DESCRIPTION OF THE PREFERRED EMBODIMENTS

Figure 1:
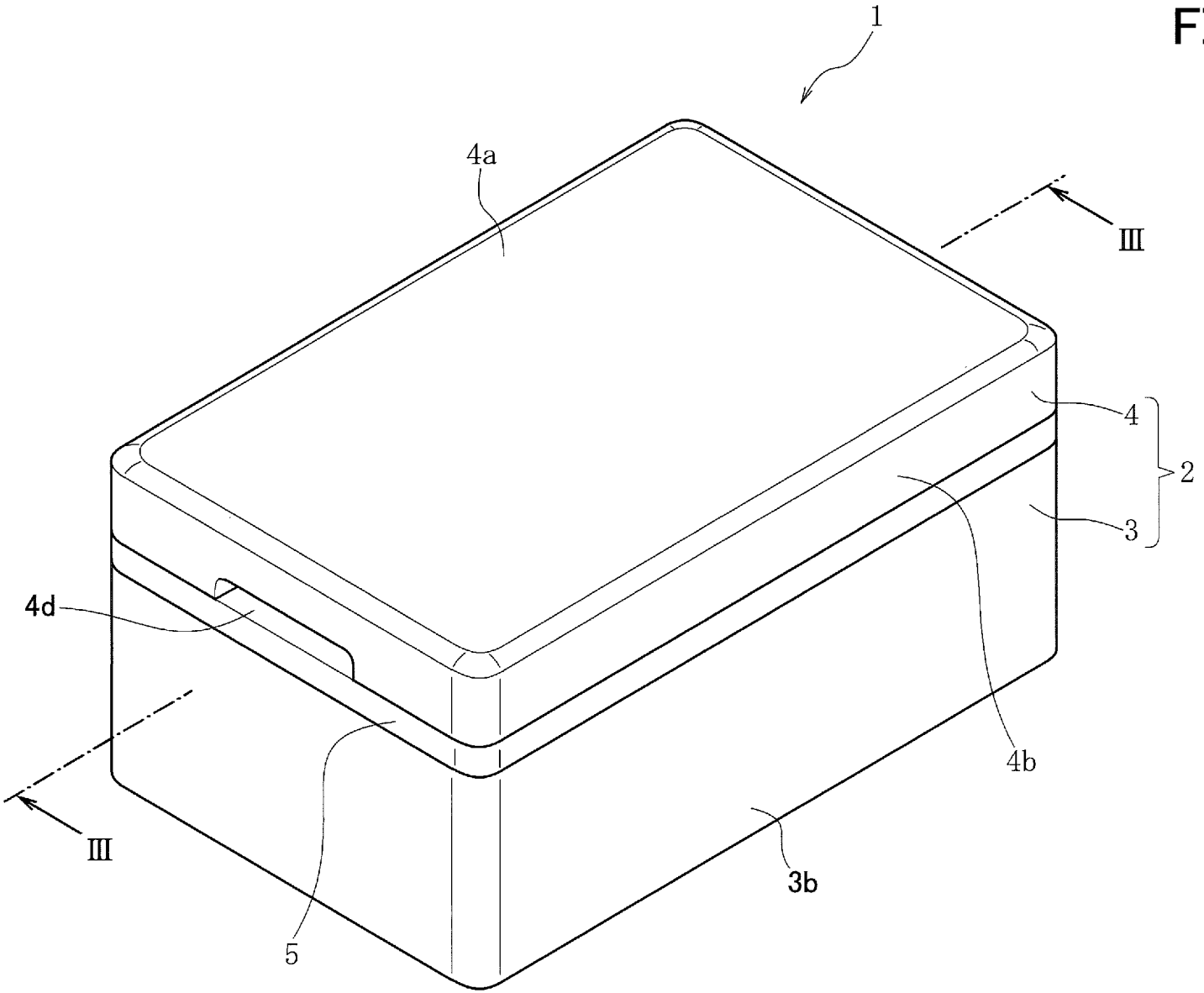
FIG. 1 is a perspective view illustrating the appearance of a sound producing device according to an embodiment of the present invention.
Figure 2:
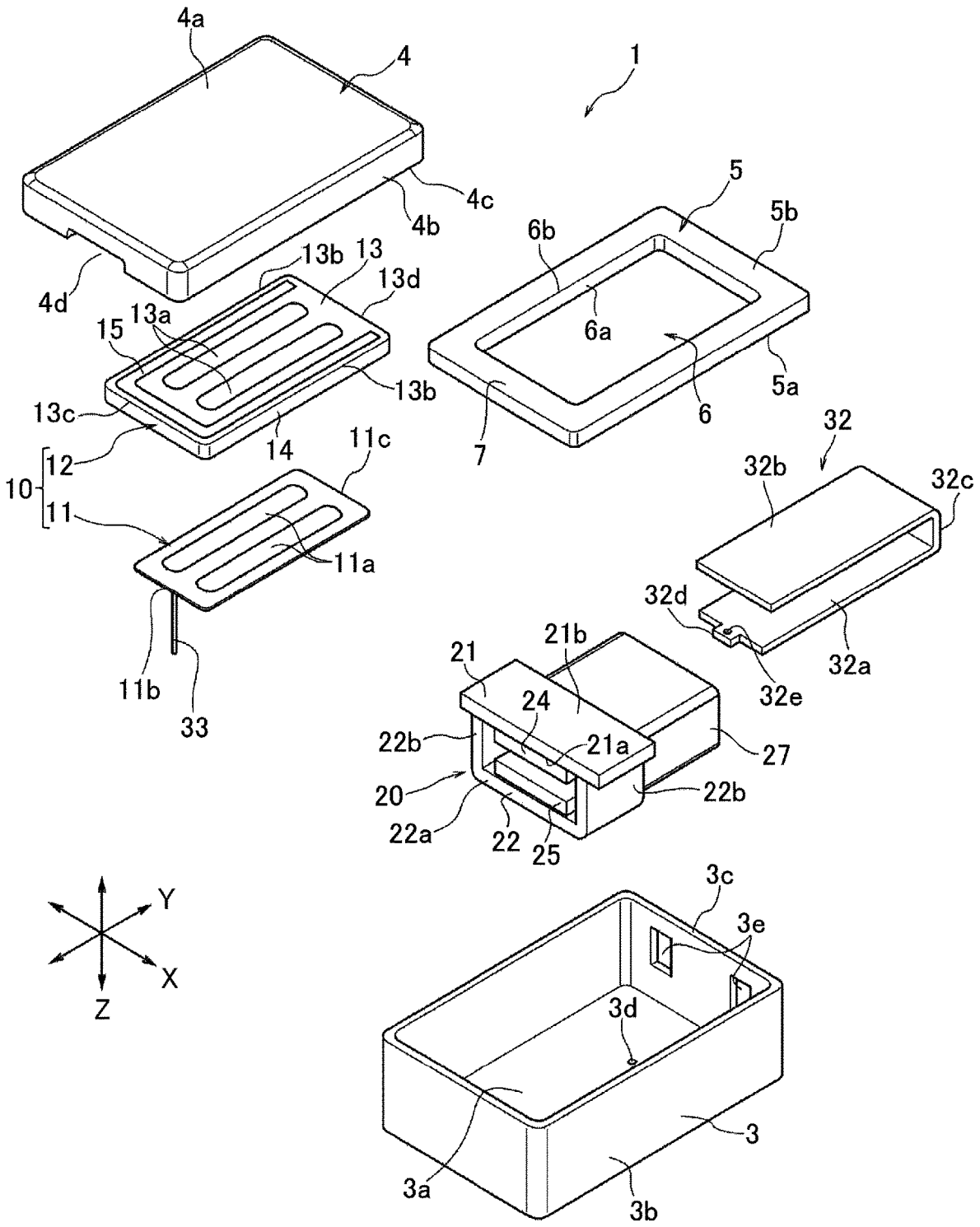
FIG. 2 is an exploded perspective view illustrating the sound producing device according to the embodiment of the present invention.

As illustrated in FIG. 1 and FIG. 2, a sound producing device 1 according to an embodiment of the present invention includes a case 2. The case 2 is composed of a first case 3 and a second case 4. The first case 3 is a lower case and the second case 4 is an upper case, both of which are formed by pressing from a non-magnetic metal plate or a magnetic metal plate.

As illustrated in FIG. 2, the first case 3 includes a bottom portion 3*a*, a side wall portion 3*b* surrounding the four side surfaces, and an opening end portion 3*c* at the upper end of the side wall portion 3*b*. The second case 4 includes a ceiling portion 4*a*, a side wall portion 4*b* surrounding the four side surfaces, and an opening end portion 4*c* at the lower end of the side wall portion 4*c*. The internal space of the first case 3 is wider than the internal space of the second case 4, and the second case 4 functions as the lid of the first case 3.

Figure 3:
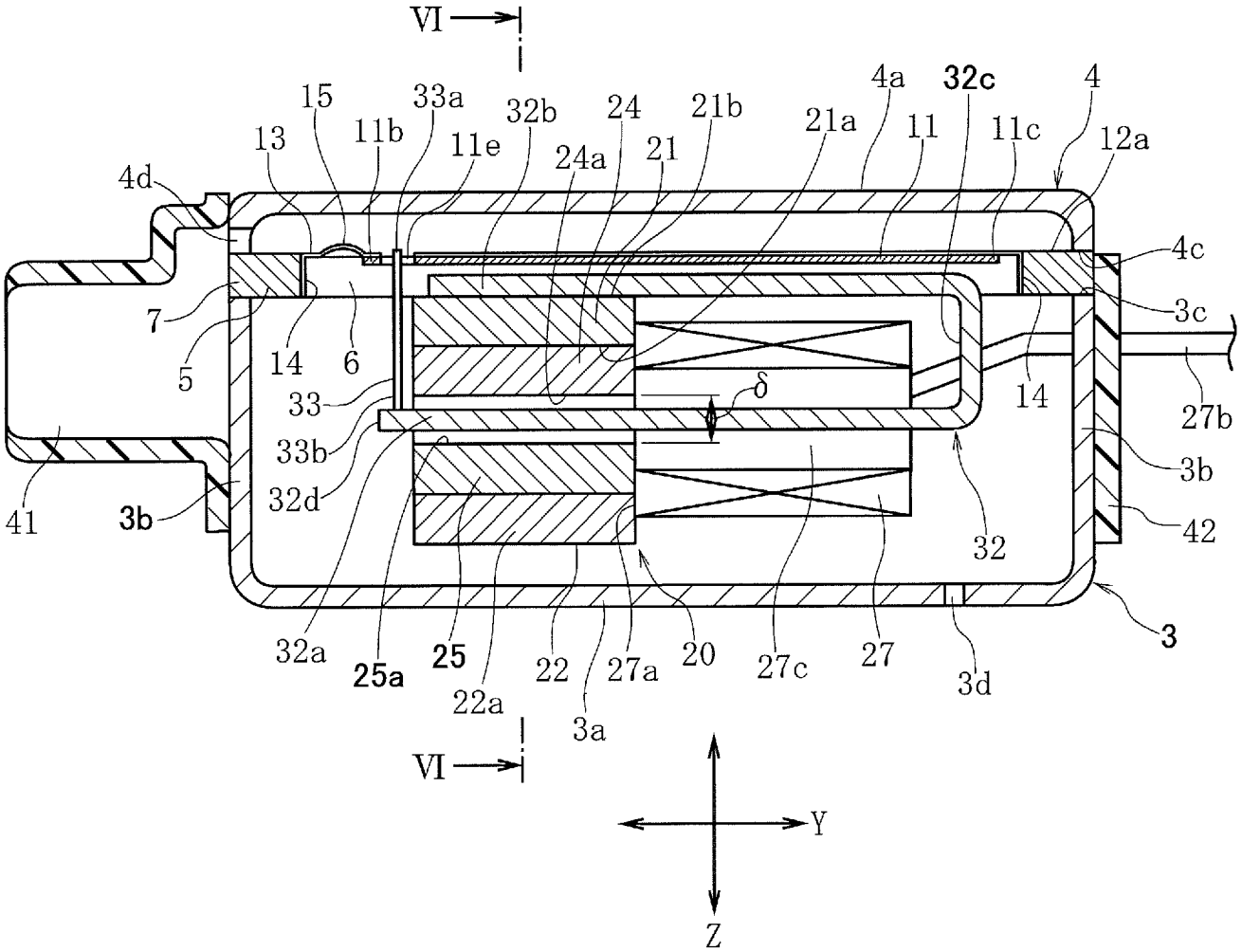
FIG. 3 is a cross-sectional view of the sound producing device illustrated in FIG. 1, taken along the line
Figure 6:
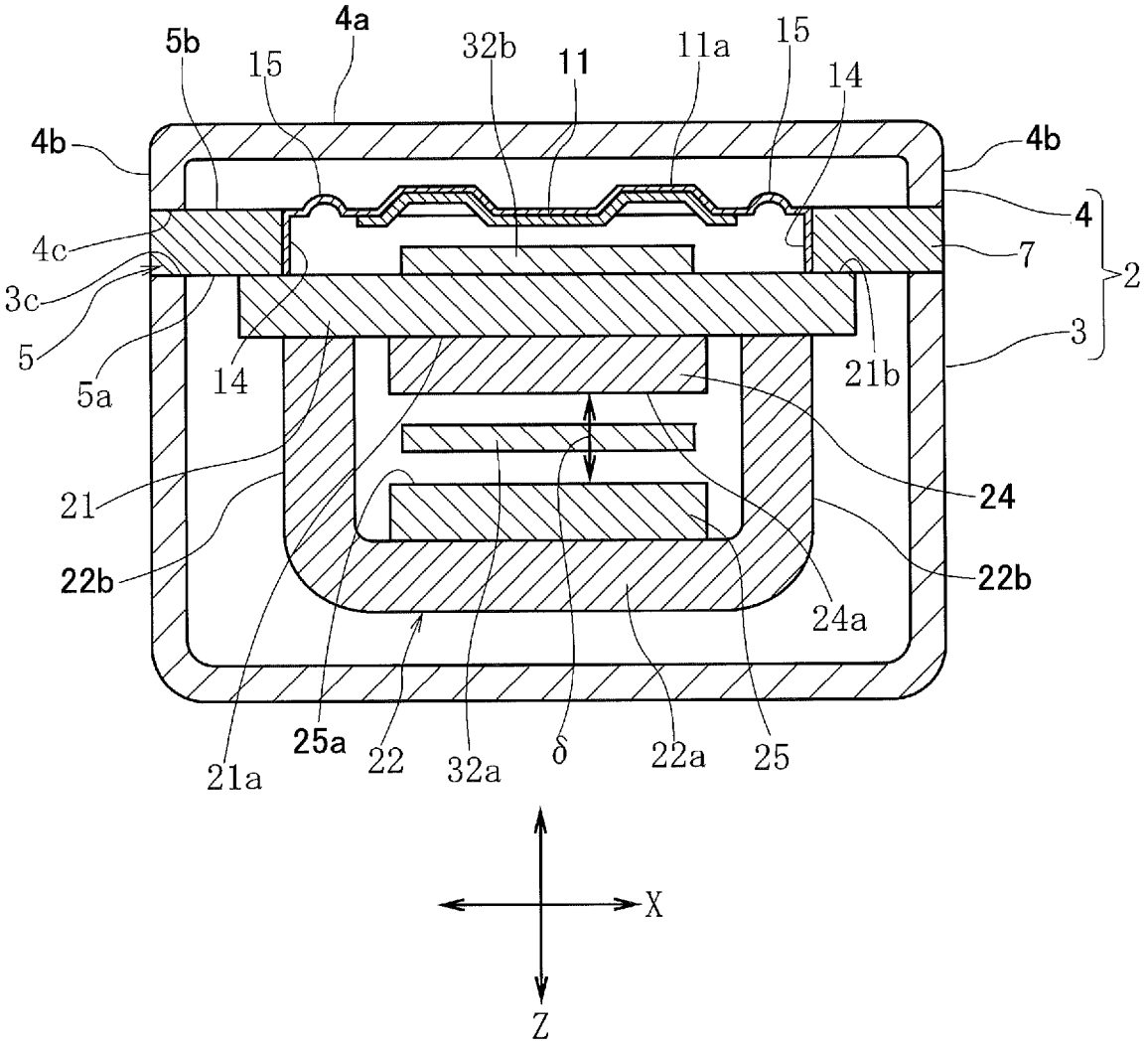
FIG. 6 is a cross-sectional view of the sound producing device illustrated in FIG. 3, taken along the line VI-VI.

As illustrated in FIG. 3 and FIG. 6, a frame 5 is sandwiched between the opening end portion 3*c* of the first case 3 and the opening end portion 4*c* of the second case 4. As illustrated in FIG. 2, the frame 5 is formed of a metal plate material of non-magnetic material or magnetic material having a uniform thickness in the Z direction. The frame 5 has a lower surface 5*a* facing the first case 3 and an upper surface 5*b* facing the second case 4. An opening portion 6 is formed to penetrate vertically at the center of the frame 5. The opening portion 6 is a rectangular hole. On the peripheral edge of the opening portion 6, an inner end surface 6*a* perpendicular to the lower surface 5*a* and the upper surface 5*b* is formed. The inner end surface 6*a* is a vibrator attachment surface. Also, the boundary portion between the upper surface 5*b* of the frame 5 and the inner end surface 6*a* of the opening portion 6 is an opening edge portion 6*b*.

A portion of the lower surface 5*a* of the frame 5 is a drive mechanism attachment surface. The outer peripheral portion of the frame 5 is a sandwiched portion 7 that is sandwiched between the first case 3 and the second case 4.

As illustrated in FIG. 3, FIG. 4, FIG. 6, and FIG. 7, a vibrator 10 is attached to the opening portion 6 of the frame 5. The vibrator 10 is composed of a vibration plate 11 and a vibration support sheet 12. The vibration plate 11 is formed of a thin metal material such as aluminum or SUS304. The vibration support sheet 12 is more flexible and deformable than the vibration plate 11 and is foisted, for example, of a resin sheet (resin film) such as PET (polyethylene terephthalate), nylon, or polyurethane.

Figure 7:
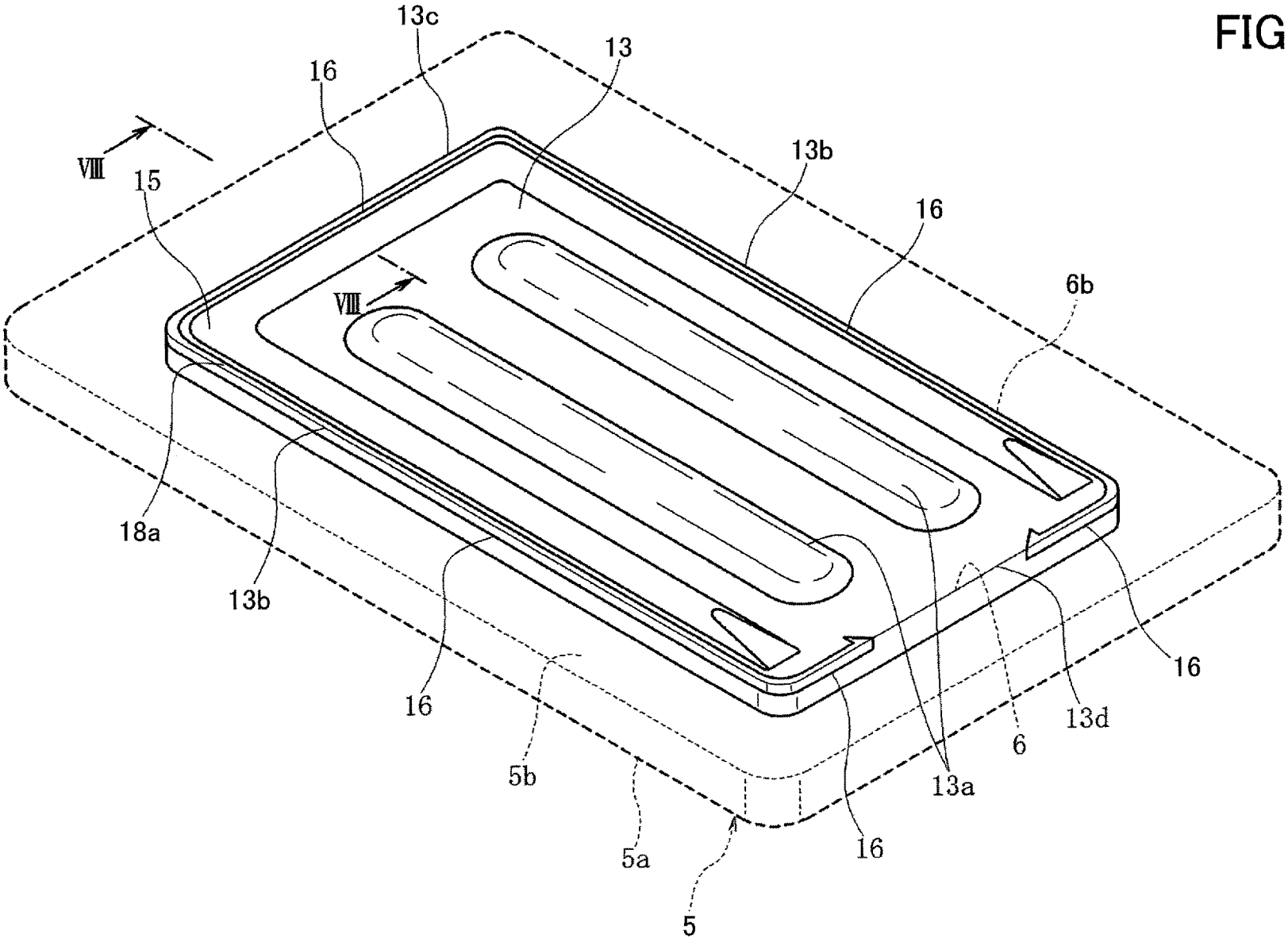
FIG. 7 is a perspective view illustrating an adhesive structure of the frame and a vibration support sheet provided in the sound producing device.

The vibrating plate 11 is rectangular and oblong. The area of the vibration plate 11 is less than the opening area of the opening portion 6 of the frame 5. As illustrated in FIG. 2, FIG. 6, and FIG. 7, a plurality of reinforcing ribs 11*a* extending in the Y direction are formed on the vibration plate 11. The reinforcing ribs 11*a* are formed to protrude toward the second case 4.

Figure 4:
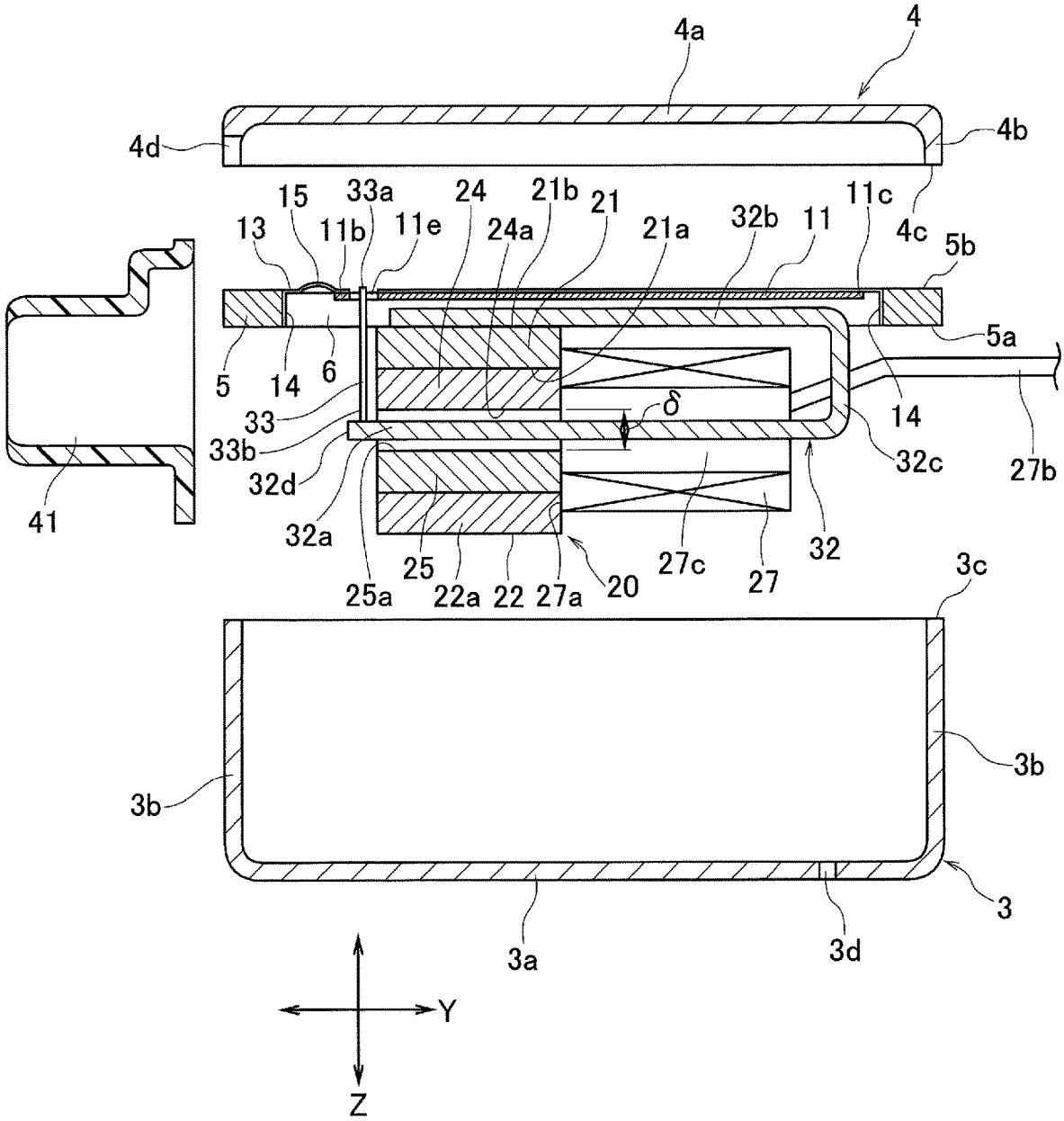
FIG. 4 is an exploded cross-sectional view illustrating the sound producing device illustrated in FIG. 3.

The area of the vibration support sheet 12 is larger than that of the vibration plate 11. As illustrated in FIG. 2 and FIG. 7, the vibration support sheet 12 includes a vibration plate support portion 13, which is a rectangular-shaped surface parallel to the X-Y plane, and a peripheral fixation portion 14, which is bent downwardly from the entire periphery of the vibration plate support portion 13. As illustrated in FIG. 3, FIG. 4, and FIG. 6, the peripheral fixation portion 14 faces and is bonded to the inner end surface 6*a* of the opening portion 6 formed in the frame 5. At the time of this bonding operation, the peripheral fixation portion 14 of the vibration support sheet 12 is pressed to the inner end surface 6*a* by a die or the like. Thereby, on a peripheral edge portion of the vibration plate support portion 13, the peripheral fixation portion 14 downwardly bent is formed.

A central portion of the vibration plate support portion 13 of the vibration support sheet 12 is a vibration plate adhesion area, and the vibration plate 11 is bonded and fixed to the vibration plate adhesion area of the vibration plate support portion 13 from the lower side. Therefore, on the vibration plate adhesion area of the vibration plate support portion 13 in the vibration support sheet 12, ribs 13*a* that are in accordance with the reinforcing ribs 11*a* of the vibration plate 11 are formed.

Figure 8:
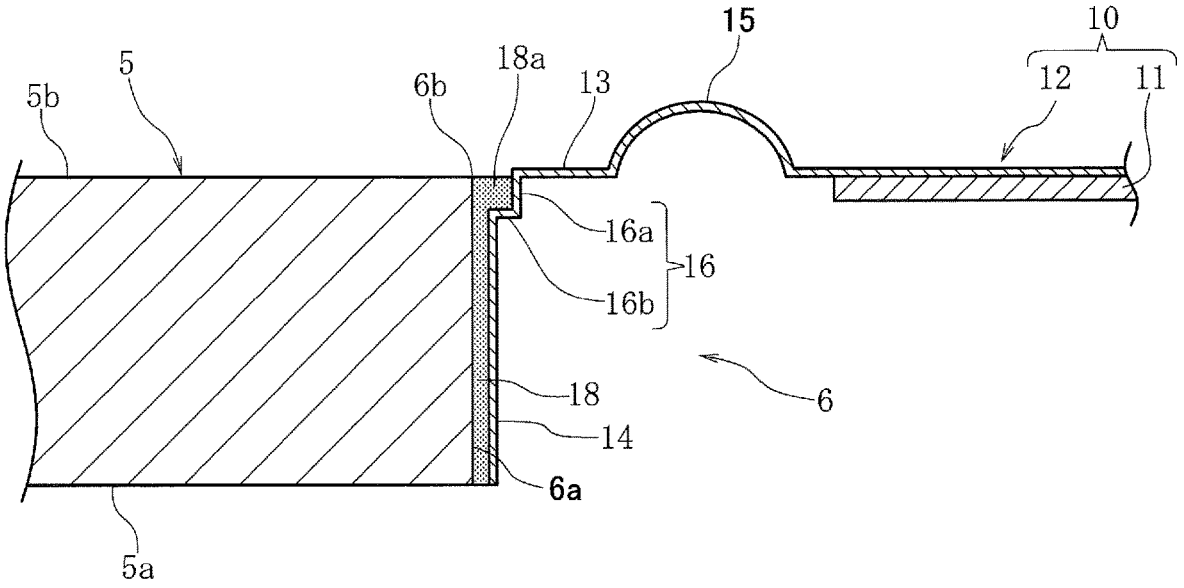
FIG. 8 is a partial cross-sectional view illustrating the bonding structure of the frame and the vibration support sheet, taken along the line VIII-VIII of FIG. 7.

As illustrated in FIG. 2, FIG. 7, and FIG. 8, on the vibration plate support portion 13 of the vibration support sheet 12, a raised deformation portion 15 is formed to surround the vibration plate adhesion area to which the vibration plate 11 is bonded. The raised deformation portion 15 is continuously formed along two long sides 13*b* and 13*b* of the vibration plate support portion 13 and one short side 13*c* that is the free end side of vibration. The vibration plate 11 is not bonded to the vibration plate support portion 13. As illustrated in the cross-sectional views of FIG. 3 and FIG. 8, the raised deformation portion 15 is formed to bend and protrude upward (in the direction toward the second case 4). Note that the raised deformation portion 15 may be formed to bend and protrude downwardly toward the inside of the opening portion 6.

As illustrated in FIG. 7 and FIG. 8, on the vibration plate support portion 13 of the vibration support sheet 12, a peripheral recessed portion 16 is formed on the outer peripheral side with respect to the raised deformation portion 15.

As illustrated in FIG. 7, the peripheral recessed portion 16 is formed on the entire length of the two long sides 13*b* and 13*b* of the vibration plate support portion 13, the entire length of the short side 13*c* that is the free end side of vibration, and both side portions of the short side 13*d* that is the fulcrum support side of vibration. As enlarged in FIG. 8, the peripheral recessed portion 16 has a shape of a corner groove having a side surface 16*a* recessed downwardly and perpendicularly from the surface of the vibration plate support portion 13 and a bottom surface 16*b* that turns perpendicularly from the side surface 16*a* in the outer peripheral direction. Note that the peripheral recessed portion 16 may be configured such that its cross-sectional shape is a concave surface or an inclined surface.

When the vibration support sheet 12 is attached to the frame 5, the peripheral fixation portion 14 is caused to face and to be pressed to the inner end surface 6*a* of the opening portion 6 foisted on the frame 5 to adhere. At this time, by a heated die or the like, the peripheral fixation portion 14 is bent-shaped from the vibration plate support portion 13 and at the same time, the raised deformation portion 15 and the peripheral recessed portion 16 are shaped.

As enlarged in FIG. 8, the peripheral fixation portion 14, which is bent downward from the four sides of the vibration plate support portion 13, faces the inner end surface 6*a* of the opening portion 6 formed on the frame 5, an adhesive layer 18 is interposed between the peripheral fixation portion 14 and the inner end surface 6*a*, and the peripheral fixation portion 14 is fixed to the inner end surface 6*a*. Also, a portion of the adhesive constituting the adhesive layer 18 transfers to the peripheral recessed portion 16 such that an adhesive pool 18*a* is foisted. As illustrated in FIG. 7, at the long sides 13*b* and 13*b*, the short side 13*c*, and part of the short side 13*d* of the vibration support portion 13 of the vibration support sheet 12, the adhesive pool 18*a* is formed at the boundary portion between the opening edge portion 6*b* of the opening portion 6 of the frame 5 and the vibration plate support portion 13.

By the adhesive pool 18*a* being foisted, the vibration support sheet 12 is firmly bonded and fixed to the opening portion 6 of the frame 5. Also, on the vibration plate support portion 13, because the peripheral recessed portion 16 is located at a position away from the raised deformation portion 15 in the outer peripheral direction, the adhesive constituting the adhesive pool 18*a* does not extend to the raised deformation portion 15 and the adhesive can be prevented from adhering to the raised deformation portion 15. Accordingly, the stiffness of the raised deformation portion 15 can be prevented from being increased by adhesion of the adhesive, the flexibility of the raised deformation portion 15 can be maintained, and the vibration characteristics of the vibration plate 11 can be stabilized.

As illustrated in FIG. 2, the vibration plate 11 has a free end lib and a fulcrum side end portion 11*c*. The vibration plate 11 can be vibrated so that the free end 11*b* is displaced in the Z direction with the fulcrum side end portion 11*c* as the fulcrum, mainly due to deflection and elasticity of the raised deformation portion 15 of the vibration support sheet 12.

As illustrated in FIG. 3 and FIG. 4, a drive mechanism 20 is attached to the frame 5. The drive mechanism 20 includes a first yoke 21 and a second yoke 22. The first yoke 21 and the second yoke 22 are formed of a magnetic material such as a Ni—Fe alloy or a rolled steel plate.

As illustrated in FIG. 2, the second yoke 22 is bent in a U shape such that a bottom surface portion 22*a* and a pair of side surface portions 22*b* and 22*b* bent upwardly on both sides in the X direction are formed. The upper end portions of the side surface portions 22*b* and 22*b* are joined to the inner surface 21*a* of the flat plate-shaped first yoke 21 and the first yoke 21 and the second yoke 22 are fixed by laser spot welding or the like. When the first yoke 21 and the second yoke 22 are fixed, the inner surface of the bottom surface portion 22*a* of the second yoke 22 and the inner surface 21*a* of the first yoke 21 face in parallel.

As illustrated in FIG. 2, FIG. 3, FIG. 4, and FIG. 6, in the drive mechanism 20, a first magnet 24 is fixed to the inner surface 21*a* of the first yoke 21 and a second magnet 25 is fixed to the inner surface of the bottom surface portion 22*a* of the second yoke 22. A magnetization surface 24*a* of the first magnet 24 and a magnetization surface 25*a* of the second magnet 25 are magnetized so as to have polarities opposite each other. A gap δ is set in the Z direction between the magnetization surface 24*a* of the first magnet 24 and the magnetization surface 25*a* of the second magnet 25.

As illustrated in FIG. 2 and FIG. 3, a coil 27 is provided in the drive mechanism 20. The coil 27 is wound such that a coated conductive wire is wound about a winding axis extending in the Y direction as a center. A wound end portion 27*a* oriented in the Y axis direction of the coil 27 is bonded and fixed to the first yoke 21 and the second yoke 22.

As illustrated in FIG. 2, FIG. 3, and FIG. 4, an armature 32 is provided in the drive mechanism 20. The armature 32 is formed of a magnetic plate material having a uniform thickness, and is formed of a Ni—Fe alloy, for example. The armature 32 is press-processed into a U shape having a movable portion 32*a*, a base portion 32*b*, and a bent portion 32*c*. As illustrated in FIG. 2, a tip portion 32*d* of the movable portion 32*a* of the armature 32 oriented toward the free end side has a small width dimension in the X direction, and a connection hole 32*e* is formed to vertically penetrate the tip portion 32*d*.

Figure 5:
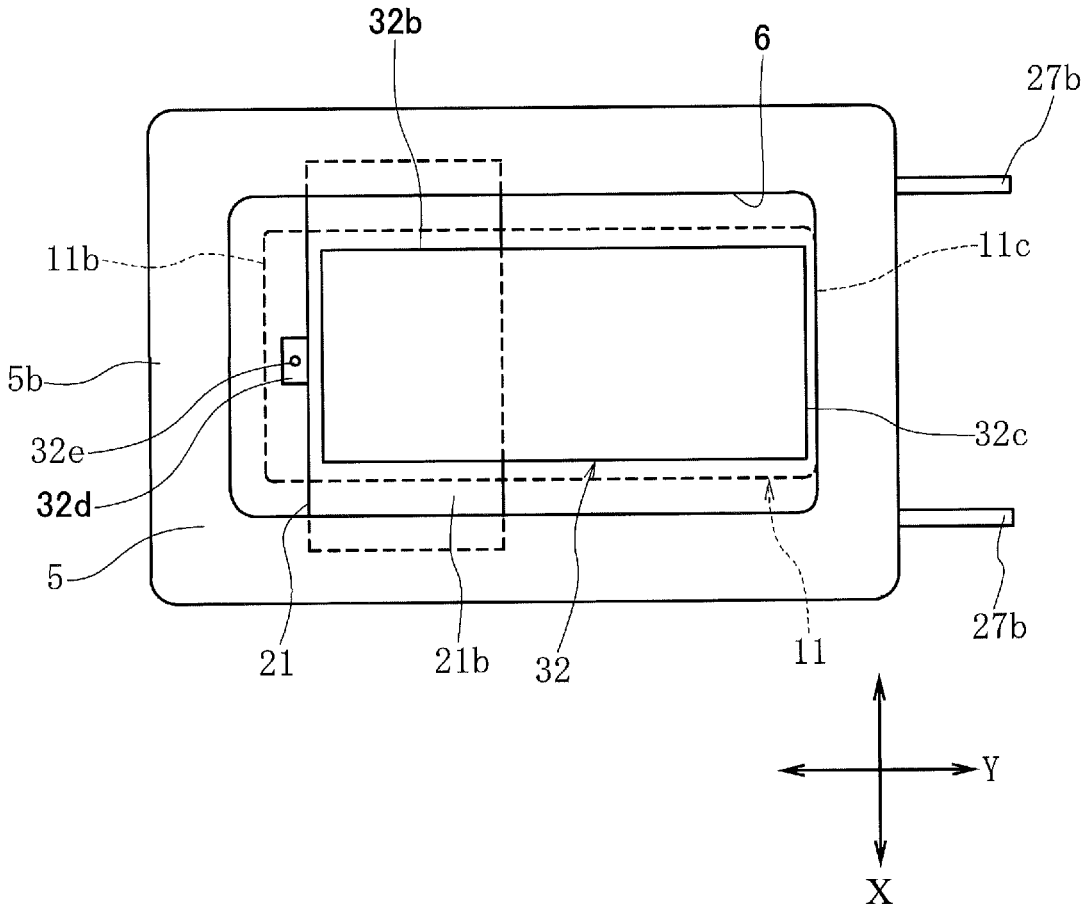
FIG. 5 is a plan view illustrating a state in which a vibration plate, a first yoke, and an armature are attached to a frame in the sound producing device according to the embodiment.

As illustrated in FIG. 3, FIG. 4, and FIG. 5, the base portion 32*b* of the armature 32 is fixed to an upward outer surface 21*b* of the first yoke 21. The movable portion 32*a* of the armature 32 is inserted in a winding space 27*c* of the coil 27 and is further inserted in the gap δ between the first magnet 24 and the second magnet 25. The tip portion 32*d* of the armature 32 protrudes toward left with respect to the gap δ as illustrated.

As illustrated in FIG. 3 and FIG. 4, the upward outer surface 21*b* of the first yoke 21 is joined to and fixed to the lower surface 5*a* of the frame 5. As illustrated in FIG. 5 and FIG. 6, the first yoke 21 is mounted to across the opening portion 6 of the frame 5 in the X direction, and both ends in the X direction of the first yoke 21 are joined to the lower surface 5*a* of the frame 5 such that the first yoke 21 and the frame 5 are fixed by laser spot welding. By the first yoke 21 and the frame 5 being fixed, the drive mechanism 20 is mounted with reference to the lower surface 5*a* of the frame 5.

As illustrated in FIG. 5, the base portion 32*b* of the armature 32 is smaller than the opening area of the opening portion 6 of the frame 5. Thus, upon the outer surface 21*b* of the first yoke 21 being fixed to the lower surface 5*a* of the frame 5, the base portion 32*b* of the armature 32 fixed to the outer surface 21*b* enters the interior of the opening portion 6 of the frame 5, as illustrated in FIG. 6. The thickness dimension of the base portion 32*b* in the Z direction is smaller than the thickness dimension of the frame 5 in the Z direction, and there is a gap in the Z direction between the vibration plate 11, which is also located within the opening portion 6, and the base portion 32*b* of the armature 32 so that the vibration plate 11 can vibrate in the Z direction.

As illustrated in FIG. 3, the free end lib of the vibration plate 11 and the tip portion 32*d* of the armature 32 are connected by a transmitter 33. The transmitter 33 is a needle-shaped member formed of a metal or a synthetic resin, and is formed of, for example, a pin material of SUS202. An upper end 33*a* of the transmitter is inserted in a mounting hole lie formed in the vibration plate 11 and the vibration plate 11 and the transmitter 33 are fixed by an adhesive or soldering. A lower end 33*b* of the transmitter 33 is inserted in a connection hole 32*e* formed in the tip portion 32*d* of the armature 32 and the transmitter 33 and the tip portion 32*d* are fixed by laser spot welding, an adhesive, or soldering. The transmitter 33 traverses vertically in the opening portion 6 of the frame 5, and a portion of the transmitter 33 is located within the opening portion 6.

As illustrated in FIG. 3 and FIG. 6, the sandwiched portion 7 at the outer periphery of the frame 5 is fixed by being sandwiched between the opening end portion 3*c* of the first case 3 and the opening end portion 4*c* of the second case 4. The first case 3, the second case 4, and the sandwiched portion 7 are fixed by laser spot welding, and the sound producing device 1 illustrated in FIG. 1 is completed.

Upon the frame 5 being sandwiched and fixed between the first case 3 and the second case 4, the space inside the case 2 is vertically sectioned by the vibration plate 11 and the vibration support sheet 12. An internal space of the second case 4 above the vibration plate 11 and the vibration support sheet 12 is a sound production side space, and the sound production side space is connected to the outside space from a sound production port 4*d* formed on the side wall portion 4*b* of the second case 4.

As illustrated in FIG. 3, a sound production nozzle 41 leading to the sound production port 4*d* is fixed to the outer side of the case 2. As illustrated in FIG. 2 and FIG. 3, an intake/exhaust port 3*d* is formed on the bottom portion of the first case 3, and an internal space of the first case 3 below the vibration plate 11 and the vibration support sheet 12 leads to the outside through the intake/exhaust port 3*d*. As illustrated in FIG. 2, a pair of wiring holes 3*e* are opened on the side wall portion 3*b* of the first case 3, and as illustrated in FIG. 3, a pair of conductive wire terminal portions 27*b* constituting the coil 27 are pulled out from the respective wiring holes 3*e*. A substrate 42 is fixed to the exterior of the side wall portion 3*b* of the case and the terminal portions 27*b* pass through a small hole formed in the substrate 42. By closing this small hole, the wiring holes 3*e* are closed from the outside.

Next, an operation of the sound producing device 1 will be described.

Upon a voice current being applied to the coil 27, a magnetic field induced by the coil 27 and a magnetic field generated between the magnetization surface 24*a* of the first magnet 24 and the magnetization surface 25*a* of the second magnet 25 provide vibrational force in the Z direction to the movable portion 32*a* of the armature 32. This vibration is transmitted through the transmitter 33 to the vibration plate 11. The vibration plate 11, which is supported by the vibration support sheet 12, vibrates such that the free end lib vibrates in the Z direction with the fulcrum side end portion 11*c* as a fulcrum. The vibration is transmitted through the vibration plate 11, a sound pressure is generated in the sound production space inside the second case 4, and this sound pressure is output from the sound production port 4*d* to the outside.

In this sound producing device 1, the peripheral fixation portion 14 of the vibration support sheet 12 that constitutes the vibrator 10 is fixed through the adhesive layer 18 to the inner end surface 6*a* of the opening portion of the frame 5. Therefore, the adhesive does not adhere to a laser spot weld portion between the first case 3 and the second case 4 and the sandwiched portion 7 of the frame 5, and an occurrence of weld defect in the laser spot weld potion can be prevented.

Also, as illustrated in FIG. 8, because the adhesive pool 18*a* is formed at the boundary portion between the opening edge portion 6*b* of the opening portion 6 of the frame 5 and the vibration plate support portion 13, the vibration support sheet 12 can be firmly fixed in the opening portion 6 of the frame 5. Furthermore, because the adhesive pool 18*a* is located away from the raised deformation portion 15 of the vibrating support sheet 12, the adhesive does not easily adhere to the raised deformation portion 15, and it is possible to prevent the stiffness of the raised deformation portion 15 from being increased by adhesion of the adhesive.

Therefore, it is possible to vibrate the vibration plate 11 with a light load based on deformation of the raised deformation portion 15 of the vibration support sheet 12.

FIG. 9 to FIG. 13 illustrate modified examples of the bonding structure of the frame 5 and the vibration support sheet 12 according to the present invention.

In the embodiment illustrated in FIG. 8, the vibration plate support portion 13 of the vibration support sheet 12 is located on a plane approximately the same as the upper surface 5*b* of the frame 5, and the adhesive pool 18*a* is formed below the upper surface 5*b* of the frame 5.

In the modified example illustrated in FIG. 9, the bottom surface 16*b* of the peripheral recessed portion 16 of the vibration support sheet 12 is located below the upper surface 5*b* of the frame 5, while the vibration plate support portion 13 is located above the upper surface 5*b*. In the modified embodiment illustrated in FIG. 10, both the vibration plate support portion 13 and the bottom surface 16*b* of the peripheral recessed portion 16 are located above the upper surface 5*b* of the frame 5.

Figure 9:
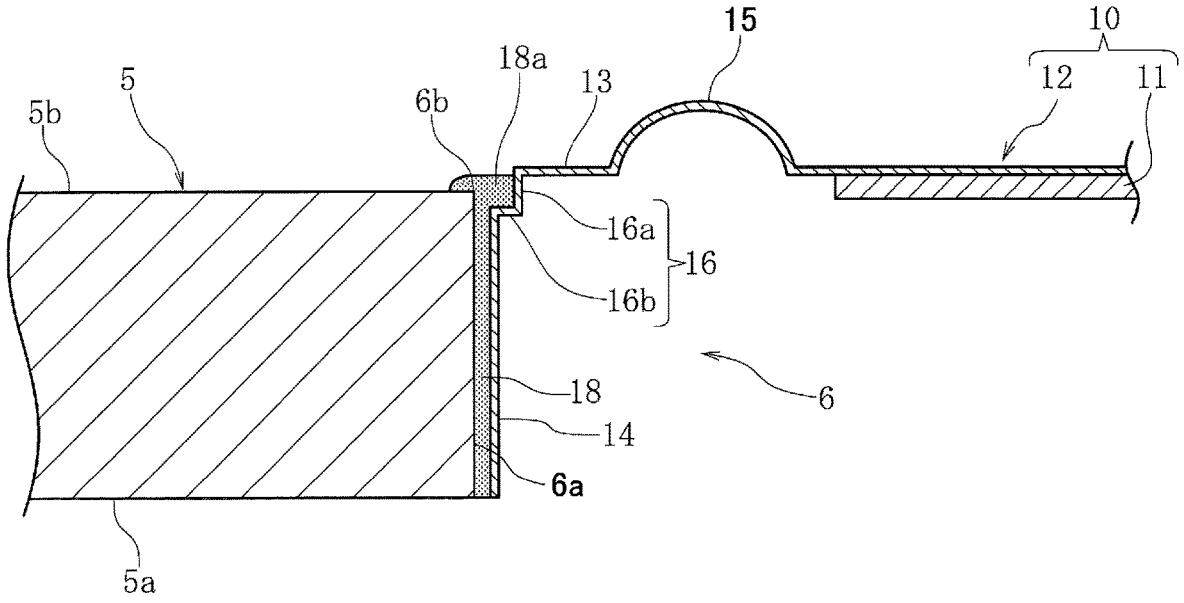
FIG. 9 is a partial cross-sectional view illustrating a modified example of an adhesive structure of a frame and a vibration support sheet.
Figure 10:
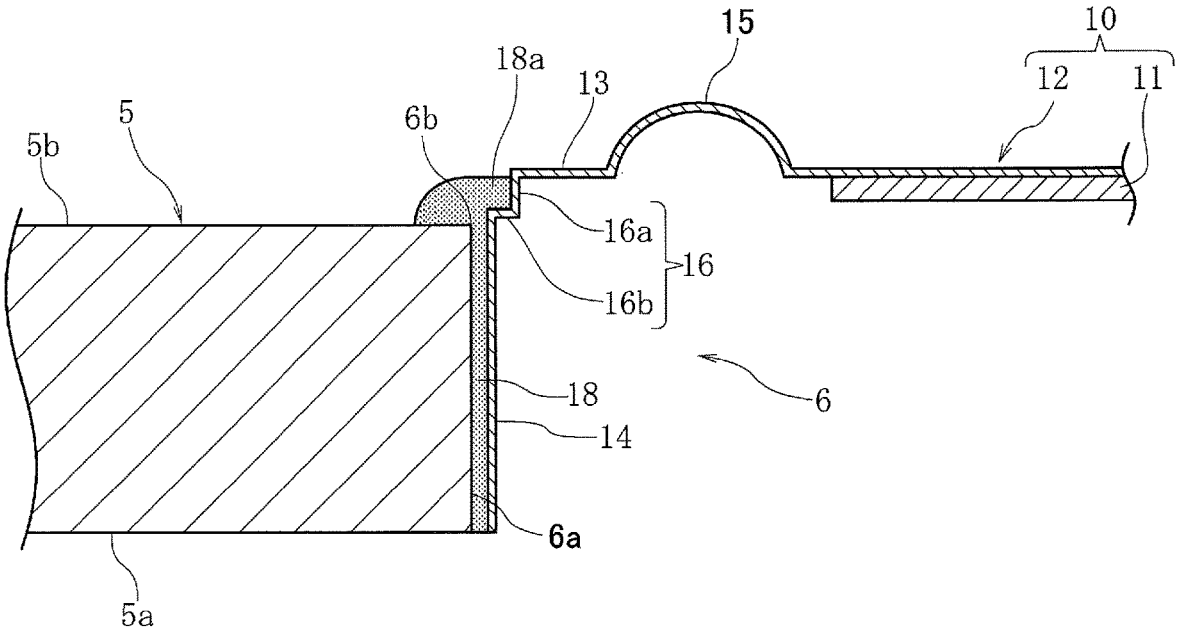
FIG. 10 is a partial cross-sectional view illustrating a modified example of an adhesive structure of a frame and a vibration support sheet.

In the modified examples illustrated in FIG. 9 and FIG. 10, although the adhesive pool 18*a* is located above the upper surface 5*b* of the frame 5, the side surface 16*a* of the peripheral recessed portion 16 blocks the adhesive. Therefore, the adhesive is prevented from adhering to the raised deformation portion 15. In FIG. 9 and FIG. 10, the adhesive of the adhesive pool 18*a* slightly flows to the upper surface 5*b* of the frame 5, and when the amount of that increases, the likelihood of reaching a laser weld portion of the first case 3 and the second case 4 and frame 5 increases. To avoid this, as illustrated in FIG. 9, it is preferable to locate the bottom surface 16*b* of the peripheral recessed portion 16 below the upper surface 5*b* of the frame 5. Further, as illustrated in FIG. 8, the vibration plate support portion 13 of the vibration support sheet 12 is preferably located on or below a plane the same as the upper surface 5*b* of the frame 5.

Figure 11:
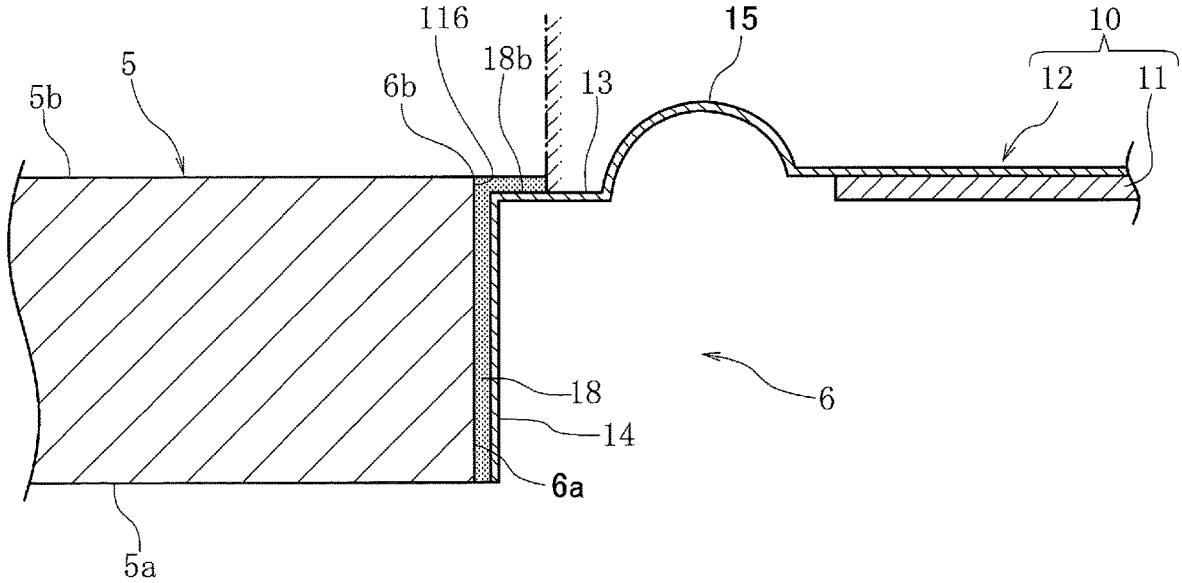
FIG. 11 is a partial cross-sectional view illustrating a modified example of an adhesive structure of a frame and a vibration support sheet.

In the modified example illustrated in FIG. 11, the vibration support sheet 12 does not have a peripheral recessed portion, and the vibration plate support portion 13 is located below the upper surface 5*b* of the frame 5. A step portion 116 is formed between the upper surface 5*b* of the frame 5 and the upper surface of the vibration plate support portion 13, and an adhesive pool 18*b* is provided at the step portion 116. Note that in order to prevent the adhesive of the adhesive pool 18*b* from flowing to the raised deformation portion 15, a stopper ST is placed on the vibration plate support portion 13 in the process of applying the adhesive to form the adhesive pool 18*b*.

Figure 12:
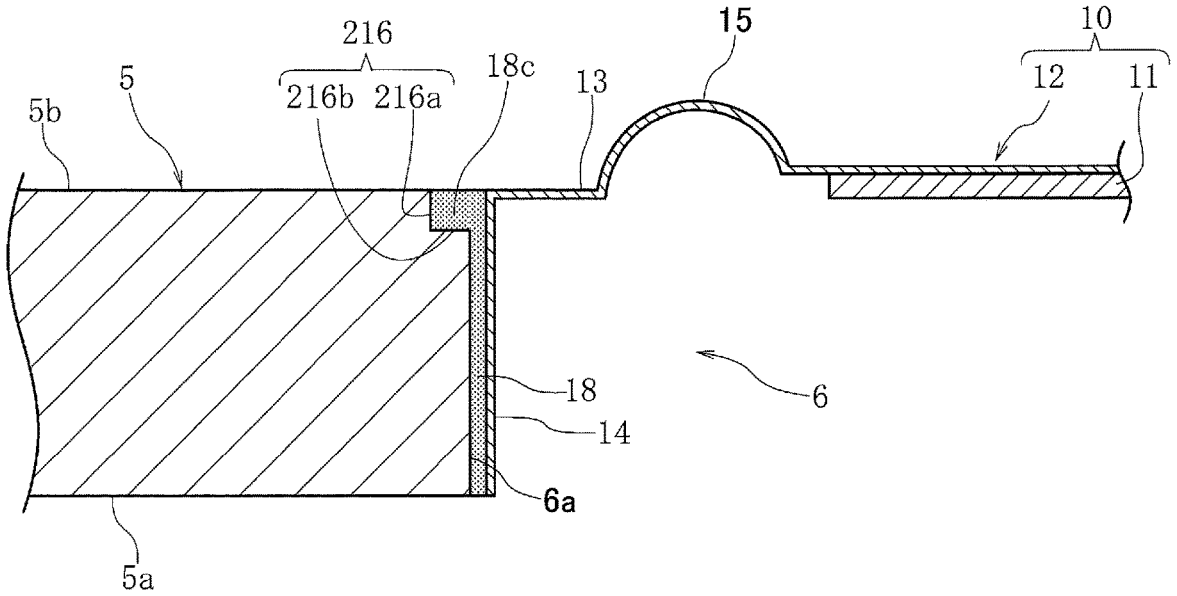
FIG. 12 is a partial cross-sectional view illustrating a modified example of an adhesive structure of a frame and a vibration support sheet.
Figure 13:
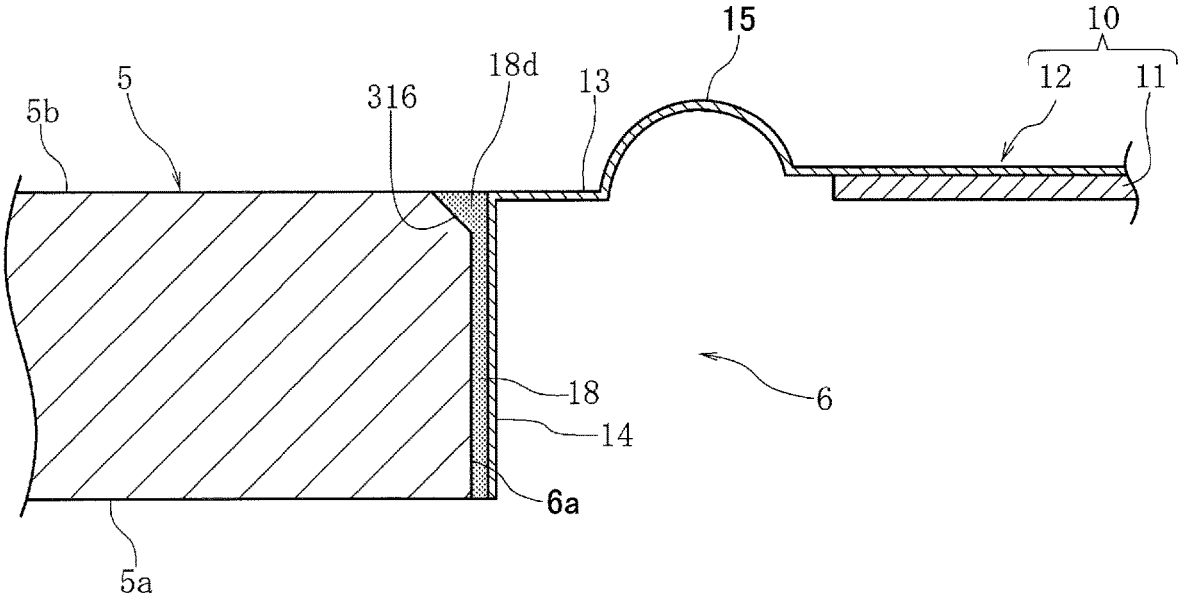
FIG. 13 is a partial cross-sectional view illustrating a modified example of an adhesive structure of a frame and a vibration support sheet.

In the modified examples illustrated in FIG. 12 and FIG. 13, the vibration support sheet 12 does not have a peripheral recessed portion 16, and frame side recessed portions 216 and 316 are formed on the upper edge portion of the inner end surface 6*a* of the opening portion 6 of the frame 5. The frame side recessed portion 216 illustrated in FIG. 12 is a corner groove having a side surface 216*a* and a bottom surface 216*b*. The frame side recessed portion 316 illustrated in FIG. 13 is an inclined surface.

In the modified examples illustrated in FIG. 12 and FIG. 13, adhesive pools 18*c* and 18*d* can also be formed between the vibration plate support portion 13 of the vibration support sheet 12 and the opening edge portion of the opening portion 6 of the frame 5.

Note that a peripheral recessed portion 16 may be formed on the vibration plate support portion 13 of the vibration support sheet 12 and a frame side recessed portion 216 or 316 may be formed on the frame 5 such that an adhesive pool may be formed at a portion where the peripheral recessed portion faces the frame side recessed portion.

What is claimed is:

1. A sound producing device comprising:

a frame having an opening portion;

a vibration plate arranged in the opening portion;

a vibration support sheet that supports the vibration plate in the opening portion; and a drive mechanism that drives the vibration plate, wherein the frame, the vibration plate, the vibration support sheet, and the drive mechanism are contained in a case, wherein the vibration support sheet includes a vibration plate support portion that covers the opening portion and the vibration support sheet includes a peripheral fixation portion that is bent from a peripheral edge portion of the vibration plate support portion and that faces an inner end surface of the opening portion, wherein the vibration plate is fixed to the vibration plate support portion, and wherein an adhesive layer is interposed at a portion where the peripheral fixation portion faces the inner end surface, and an adhesive pool is formed at a boundary portion between an opening edge portion of the opening portion of the frame and the vibration plate support portion.

2. The sound producing device according to claim 1, wherein a raised deformation portion that surrounds an adhesion area to which the vibration plate is bonded is formed on the vibration support sheet, and the adhesive pool is provided at a position away from the raised deformation portion.

3. The sound producing device according to claim 1, wherein at the boundary portion with the opening edge portion of the opening portion, a peripheral recessed portion that is recessed from the vibration plate support portion toward a center in a thickness direction of the frame is formed on the vibration support sheet, and the adhesive pool is formed in the peripheral recessed portion.

4. The sound producing device according to claim 1, wherein a frame side recessed portion that is recessed toward a center in a thickness direction of the frame is formed on the opening edge portion of the opening portion of the frame, and the adhesive pool is formed on the frame side recessed portion.

* * * * *